United States Patent [19]

Holliday

[11] 4,050,398

[45] Sept. 27, 1977

[54] PONTOON BOAT GUIDANCE SYSTEM

[75] Inventor: Carl F. Holliday, Las Vegas, Nev.

[73] Assignee: Holliday Guidance Systems, Inc., Las Vegas, Nev.

[21] Appl. No.: 686,461

[22] Filed: May 14, 1976

[51] Int. Cl.[2] ..... B63H 5/13

[52] U.S. Cl. ..... 115/18 R

[58] Field of Search ..... 114/144 R; 115/17, 18 R; 74/480 B

[56] References Cited

U.S. PATENT DOCUMENTS

| | | | |
|---|---|---|---|
| 2,961,986 | 11/1960 | Rockhill | 115/18 R |
| 2,968,273 | 1/1961 | Corbett et al. | 74/480 B |
| 3,143,994 | 8/1964 | Morse | 74/480 B |
| 3,181,491 | 5/1965 | Dunning | 74/480 B |

*Primary Examiner*—Trygve M. Blix
*Assistant Examiner*—Jesus D. Sotelo
*Attorney, Agent, or Firm*—W. Edward Johansen

[57] ABSTRACT

The invention is an improvement to a guidance system used in a pontoon boat which is powered by an outboard motor. The guidance system includes a steering wheel mechanically coupled to and mounted to the pontoon boat, a push-pull cable mechanically coupled to the steering wheel and operated in response to movement thereof, a push-pull cable mounting which is mechanically coupled to the push-pull cable and rigidly mounted to the pontoon boat. The guidance system also includes an outboard motor, having a lever arm disposed a particular distance from its vertical axis, and a base rigidly mounted to the pontoon boat and mechanically coupled to the outboard motor so that the outboard motor may pivot about its vertical axis. The improvement to the guidance system includes a first member having a first U-shaped end mechanically coupled to the push-pull cable mounting and a second U-shaped end, a second member having a first end mechanically coupled to said second U-shaped end and a second end, with the second member having a slot disposed between its first and second ends and a coupling device coupling the push-pull cable to the slot thereby mechanically coupling the second member to the push-pull cable, and a connecting device for connecting the second end of the second member to the lever arm of the outboard motor.

1 Claim, 13 Drawing Figures

Fig. 8.
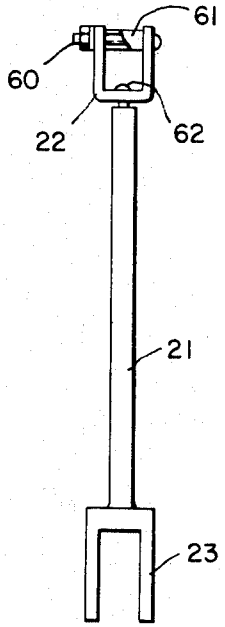
Fig. 9.
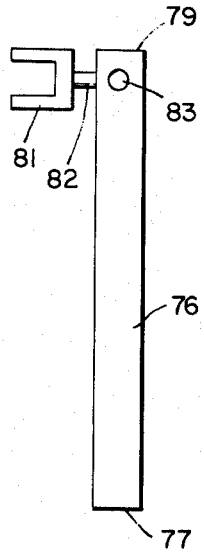
Fig. 10.
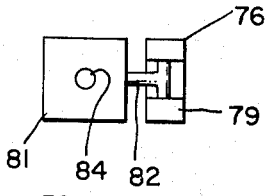
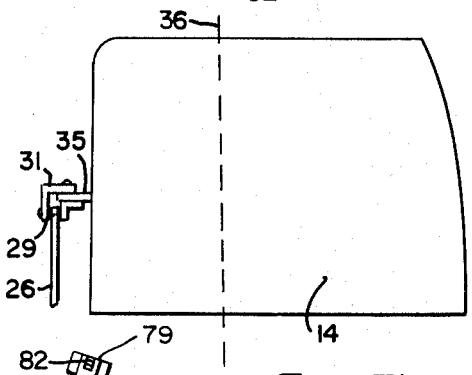
Fig. 3b
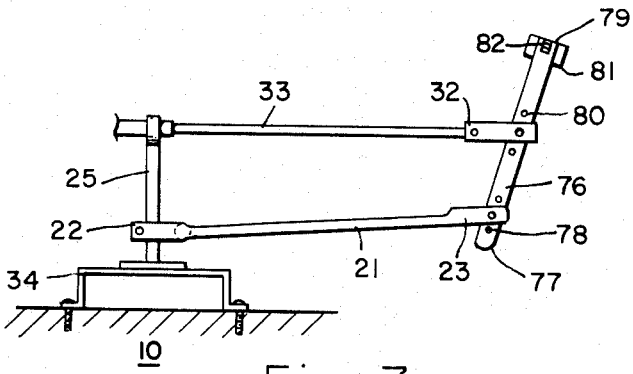
Fig. 7.
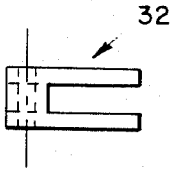
Fig. 11.
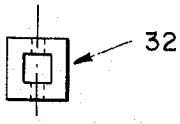
Fig. 12.

PONTOON BOAT GUIDANCE SYSTEM

BACKGROUND OF THE INVENTION

1. Field of the Invention

The present invention relates to a guidance system for a pontoon boat powered by an outboard motor and more particularly to a guidance system which reduces substantially the turning radius of the pontoon boat.

2. Description of the Prior Art

Presently the steering mechanism of a pontoon boat, powered by an outboard motor, consists of a steering wheel connected to a push-pull cable. The push-pull cable is mechanically coupled to the outboard motor so that the outboard motor pivots about its base in response to a lateral movement of the push-pull cable. The angular rotation of the outboard motor abouts its base is limited by the lateral motion of the push-pull cable. In effect, the outboard motor rotates only about thirty-five degrees in either direction from its straight line position. Although it is impossible to turn the outboard motor eighty-five degrees in either direction from the straight line position with the present steering mechanism, such as ability would enhance the maneuverability of the pontoon boat. Since pontoon boats are generally owned and used by people who enjoy fishing and relaxing in calm water, this inability to turn sharply detracts from the commercial value of the pontoon boats because they are restrained from entering small inlets along a lake front.

U.S. Pat. No. 3,143,994, entitled Steering Connection for Outboard Motors, issued to John F. Morse on Aug. 11, 1964, teaches an apparatus for efficiently connecting a mechanical motion transmitting device of the push-pull cable variety to an outboard motor. The apparatus includes a telescopically extensible connector assembly which mechanically links the core of the push-pull cable to the motor. This connector assembly is connected to the casing of the push-pull cable by a guiding member which is also anchored to the boat. Within the guiding is a telescopically reciprocable rigid cable ram member, one end of which is connected to the core of the push-pull cable and the other end of which is attached to the motor. This apparatus may be used on various types of boats, including pontoon boats. One of the object of the invention taught in this patent is to provide a steering system employing a push-pull cable in which there is no physical interference between the motor and the control cable through the full turn and tilt ranges of the motor. The above-named inventor has another patent, U.S. Pat. No. 3,013,443, which taught a push-pull cable which included in a single cable the necessary structure for effecting remote control by the application of either tensile or compressive forces.

U.S. Pat. No. 3,181,491, entitled Hydraulic Boat Steering Control, issued to Elmer D. Dunning on May 4, 1965, teaches a hydraulic boat steering control that includes a steering shaft having a pinion connected to one end thereof operatively associated with a master piston and cylinder assembly in which the piston is displaced by a rack disposed in a meshing relationship with the pinion. Associated with the directional changing device is a slave piston and cylinder assembly which is pivotally conected at one end about a fixed point. The free end of the slave assembly is connected by a piston rod to the directional changing device. A conduit device connects the respective master assembly to the slave assembly.

Furthermore, the steering mechanisms for pontoon boats are standardized and any improvement to the guidance system must be easy to install.

SUMMARY OF THE INVENTION

In view of the foregoing problems and conditions characteristic of the prior art, it is a primary object of the present invention to provide an improved pontoon boat guidance system which reduces the radius of turning for a pontoon boat.

It is another object of the present invention to provide an improved pontoon guidance system which can be manufactured from series 300 stainless steel to prevent corrosion and rust from salt water and fresh water, and be mass produced.

It is still another object of the present invention to provide an improved pontoon guidance system that can be easily installed onto existing guidance systems.

In accordance with an embodiment of the present invention an improved pontoon boat guidance system includes a steering wheel mechanically coupled to and mounted to the pontoon boat, a push-pull cable mechanically coupled to the steering wheel and operated in response to movement thereof, a push-pull cable mounting which is mechanically coupled to the push-pull cable and rigidly mounted to the pontoon boat. The guidance system also includes an outboard motor, having a lever arm disposed a particular distance from its vertical axis, and a base rigidly mounted to the pontoon boat and mechanically coupled to the outboard motor so that the outboard motor may pivot about its vertical axis. The improvement to the guidance system includes a first member having a first U-shaped end mechanically coupled to the push-pull cable mounting and a second U-shaped end, a second member having a first end mechanically coupled to said second U-shaped end and a second end, with the second member having a slot disposed between its first and second ends and a coupling device coupling the push-pull cable to the slot thereby mechanically coupling the second member to the push-pull cable, and a connecting device for connecting the second end of the second member to the lever arm of the outboard motor.

The features of the present invention which are believed to be novel are set forth with particularity in the appended claims.

Other objects and many of the attendant advantages of this invention will be more readily appreciated as the same becomes better understood by reference to the following detailed description and considered in connection with the accompanying drawing in which like reference symbols designate like parts throughout the figure.

DESCRIPTION OF THE DRAWING

FIG. 3*b* is a side view of the pontoon boat of FIG. 2 taken along the line 3*b*—3*b* illustrating the coupling of the steering mechanism to the outboard motor.

FIG. 7 is a cross-sectional view of the pontoon boat which uses another steering mechanism constructed in accordance with the principles of the present invention, showing the steering mechanism in its turning position.

FIG. 8 is a top plan view of a first member of the steering mechanism of FIG. 7.

FIG. 9 is a side view of a second member of the steering mechanism of FIG. 7.

FIG. 10 is a top plan view of the second member of FIG. 7.

FIG. 11 is a top plan view of a connecting device of the steering mechanism of FIG. 7.

FIG. 12 is a side view of the connecting device of FIG. 11.

DESCRIPTION OF THE PREFERRED EMBODIMENT

Figure 1:
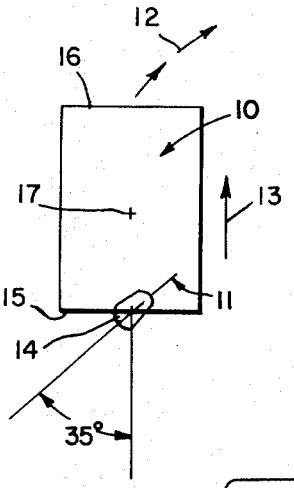
FIG. 1 is a schematic drawing of a pontoon boat which uses a prior art steering mechanism showing the turning component and the straight forward component of the pontoon boat's motion.

The present invention can best be understood by referring to FIG. 1 wherein a pontoon boat 10 is shown using a prior art steering mechanism 11 as it is turning. One can note both a turning component 12 and a straight forward component 13 of the pontoon boat's 10 motion. U.S. Pat. No. 3,143,994 describes a push-pull cable arrangement similar to the prior art steering mechanism 11. In the schematic of FIG. 1 the pontoon boat 10 also has an outboard motor 14. Although the details of the steering mechanism 11 are not shown, the steering mechanism 11 generally includes a steering wheel, which is mechanically coupled to and mounted to the pontoon boat 10, a push-pull cable mechanically coupled to the steering wheel and operated in response thereof and a push-pull cable mounting, which is mechanically coupled to the push-pull cable and rigidly mounted to the pontoon boat 10. The outboard motor 14 of the pontoon boat 10 has a lever arm disposed perpendicularly to its vertical axis at a particular distance therefrom and is mechanically coupled to a base, which is rigidly mounted to the pontoon boat 10, so it may rotate with at least 35° of freedom in either direction from its straight forward position. The push-pull cable is connected to the lever arm of the outboard motor 14 and moves back and forth in a lateral motion. Since the outboard motor 14 can only rotate a maximum of 35° in either direction from its straight forward position, there is a straight forward component 13 of the pontoon boat's motion. This straight forward component 13 is generated by a propulsion force that is perpendicular to the stern 15 of the pontoon boat 10 whereas the turning component 12 of the pontoon boat's motion is generated by a propulsion force parallel to the stern 15 of pontoon boat 10. The propulsion force parallel to the stern 15 pivots the pontoon boat 10 about its center axis 17.

Figure 2:
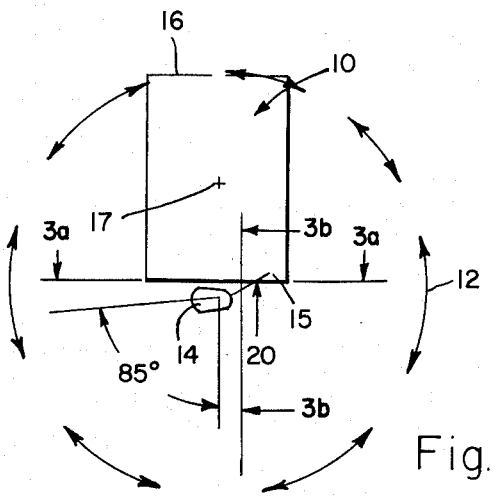
FIG. 2 is a schematic drawing of a pontoon boat which uses a steering mechanism constructed in accordance with the principles of the present invention also showing the turning component and the straight forward component of the pontoon boat's motion.

Referring now to FIG. 2, a schematic shows the pontoon boat 10 when it now used a pontoon boat guidance system 20 constructed in accordance with the principles of the present invention. One can note the absence, or virtual absence, of a straight forward component 13 of the pontoon boat's motion, because the outboard motor 14 may now be turned almost 90° in either direction from its straight forward position, thereby eliminating the propulsion force perpendicular to the stern 15. The pontoon boat 10 can now pivot sharply about its center axis 17.

Figure 3A:
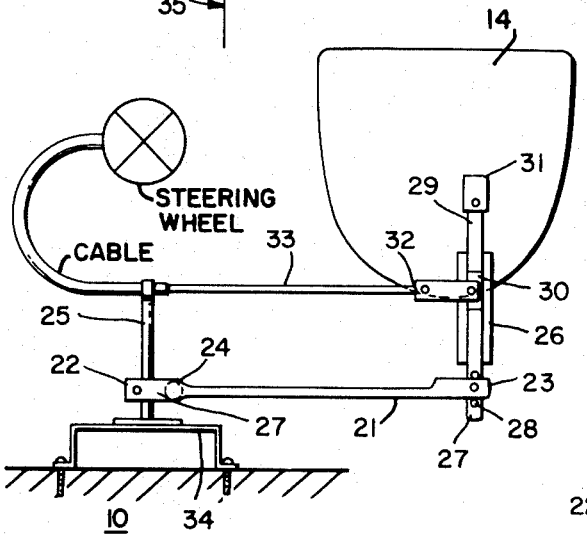
FIG. 3*a* is a cross-sectional view of a pontoon boat of FIG. 2 taken along line 3*a*—3*a* which uses a steering mechanism constructed in accordance with the principles of the present invention, showing the steering mechanism in its straight forward position.
Figure 4:
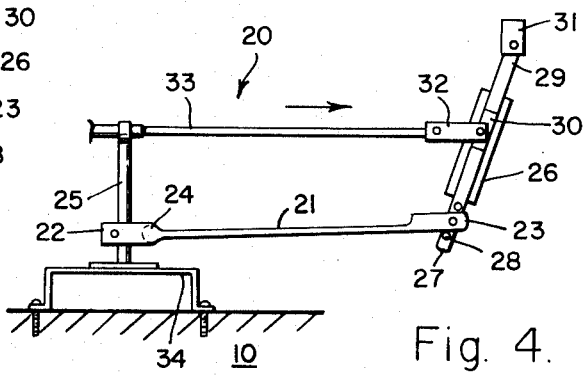
FIG. 4 is a cross-sectional view of the pontoon boat of FIG. 2 taken along line 3*a*—3*a* showing the steering mechanism in its turning position.

In order to best understand the present invention one must now refer to FIG. 3*a*, FIG. 3*b* and then to FIG. 4 in conjunction with FIG. 3*a* and FIG. 3*b*. In FIG. 3*a* and FIG. 3*b* the guidance system 20 is located on the floor of the pontoon boat 10 adjacent to its stern 15 includes a first member 21 having a first U-shaped end 22 and a second U-shaped end 23, with the U-shaped ends 22 and 23 being disposed in an angle rather than the same plane. The first member 21 also has a pivot joint 24 which is disposed adjacent the first U-shaped end 22. The length of the first member 21 is determined by the placement of a push-pull cable mounting 25 to which the first end 22 of the first member is mechanically coupled so that it may pivot in a vertical plane at least 30° in two directions from the horizontal line and to which the first member 21 is perpendicularly disposed when the pontoon boat is moving straight forward. The guidance system 20 also includes a second member 26 having a first end 27, with a set of three adjacent holes 28 which provide different steering settings, and a second end 29. The second member has a longitudinal slot 30 disposed between its two ends 27 and 29. The first end 27 of the second member 26 is mechanically coupled to the second U-shaped end 23 of the first member 21 so that it may pivot in a vertical plane at 90° in either direction from a line perpendicular to the horizontal line. The second end 29 of the second member 26 is mechanically coupled to a lever arm 35 of the outboard motor 14 by two L-shaped connectors 31, which are mechanically coupled so that they allow the lever arm to pivot with at least 90° of freedom in either direction from a line perpendicular to the stern 15. Reference to FIG. 3*b* shows the two L-shaped connectors 31 mechanically coupled to the lever arm 35 of the outboard motor 14. The lever arm 35 is coupled to the L-shaped connectors 31 so that they may pivot plus or minus ninety degrees (+ or − 90°) about the lever arm 35. The L-shaped connectors 31 are mechanically coupled to the second member 26 at its second end so that they may pivot plus or minus forty five degrees (+ or − 45°) about the second end 29 of the second member 26. The guidance system 20 finally includes a coupling device 32 which is mechanically coupled to the second member 26 so that it is slideably received in the longitudinal slot 30 of the second member 26. A push-pull cable 33 is mechanically coupled to the coupling device 32 and is also mechanically coupled to the push-pull cable mounting 25.

In FIG. 4 the push-pull cable 33 has been extended. The first member has pivoted approximately 5° above the horizontal line. The second member 26 has pivoted approximately 20° from the perpendicular line so that the L-shaped connectors 31 have moved laterally a distance twice as far as the push-pull cable 33 has been extended without changing its vertical plane. The lateral movement of the L-shaped connectors 31 displaces the lever arm of the outboard motor 14 an equal distance thereby turning the outboard motor approximately twice as many degrees as the push-pull cable 33 turns the outboard motor 14 without the guidance system 20.

The pivot angle of the second member is determined by the deflection or extension of the push-pull cable 33 divided by one-half the length of the second member 26 and by then using the arc cosine of the quotient. The pivot angle of the first member 21 is determined by dividing the length of the first member 21 by the length of the second member 26 and multiplying by one minus the cosine of the pivot angle of the second member 26 and by then finding the arc-sine of the product.

Figure 5:
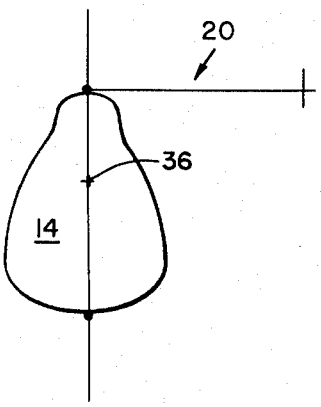
FIG. 5 is a top plan view of the pontoon boat of FIG. 3 showing the steering mechanism in its straight forward position.
Figure 6:
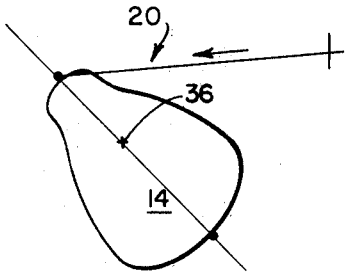
FIG. 6 is a top plan view of the pontoon boat of FIG. 3 showing the steering mechanism in its turning position.

The outboard motor 14 rotates about its pivot point 36 shown in FIG. 5 and FIG. 6 and on an axis which is disposed perpendicular to the floor of the pontoon boat 10. The lever arm 35 of the outboard motor 14 is disposed orthogonally to the axis perpendicular to the pivot point 36. Referring back again to FIG. 4 in conjunction with FIG. 3*b* it can be seen that the second member 26 pivots about its second end 29. The first end 22 of the first member 21 is mechanically coupled to the push-pull cable mounting 25 so that it pivots off its pivot joint 24 so that it may be raised or lowered. The second member 26 pivots about its first end 27 adjacent to and mechanically coupled to the second end 23 of the first member 21. The L-shaped connectors 31 can only rotate about the axis which is perpendicular to the lever arm 35 of the outboard motor 14, the outboard motor can only rotate about the axis perpendicular to the pivot point 36, and the arcuate path of the second end 29 of the second member 26 is compensated for by the dual pivot points, at the first end 22 of the first member 21 and at the second end 23 of the first member 21.

Referring now to FIG. 5 which is a schematic drawing of the outboard motor 14 when the pontoon boat 10 is moving in a straight forward direction, the outboard motor 14 is disposed perpendicular to the stern 15. Referring now to FIG. 6, which is a schematic drawing of the outboard motor 14 when the pontoon boat 10 is turning about its center axis 17 and moving in an angular forward direction, the outboard motor 14 is disposed at a 45° with respect to the stern 15 and in response to a pivot angle of approximately 22.5° of the second member 26 in FIG. 4. The effect of the guidance system 20 is to add 100° to the angular rotation of the outboard motor 14 which is normally obtained by the standard steering mechanism.

Referring again to FIG. 3*a* a description of how to install the guidance system 20 is presently existing steering mechanisms will illustrate how easy this guidance system 20 is to install. In order to install the guidance system 20 onto an existing steering mechanism the inventor has found that it is necessary to provide a U-shaped platform 34 which is rigidly mounted to the pontoon boat 10 and to which the push-pull cable mounting 25 is rigidly secured. The first member is mechanically coupled to the push-pull cable mounting at its first end. The second member is mechanically coupled to the second end of the first member at its first end and to the lever arm of the outboard motor through the connecting device. The push-pull cable 33 is mechanically coupled to the longitudinal slot of the second member by the coupling device which has been adapted to be slideably received by the longitudinal slot.

Another embodiment of the present invention is shown in FIG. 7 wherein several modifications to the first member 21 which is also shown in FIG. 8 as having a first U-shaped member 22 which is mechanically coupled to the push-pull cable mounting 25 by a bolt 60 which is covered with a plastic sheath to protect the push-pull cable mounting 25. The first U-shaped member 22 is pivotally mounted to one end of the first member 21 by a bolt 62. A second member 76 that has a first end 77 having a first set of three holes 78 and a second end 79. The second member 76 has a second set of three holes 80 replacing the slot 30 in the second member 26 of FIG. 3.

Referring now to FIG. 9 and FIG. 10 in conjunction with FIG. 7, the second member 76 has a U-shaped member 81 that has the leg of a T-shaped member 82 pivotally mounted to the base of the U-shaped member 81. The second member 76 has a base 83 located at its second end 79 and disposed so that the bar of the T-shaped member 82 can be inserted therein. The U-shaped member 81 has a set of holes 84 through its sides so that the lever arm of the outboard motor 14 can be joined to the U-shaped member 81. The U-shaped member 81 can rotate about the axis formed by the leg of the T-shaped member 82 and both the leg of the T-shaped member 82 and both the leg of the T-shaped member 82 and the U-shaped member 81 can rotate with 90° of freedom in the vertical plane about the axis formed by the bar of the T-shaped member 82 so that the outboard motor 14 may be raised.

Referring to FIG. 11 and FIG. 12, which are a top plan view and a side view of the connecting device 32, respectively, the connecting device 32 has a clevis so that the push-pull cable 33 does not pivot once it is attached.

The inventor has made his first prototype out of steel, but for production maufacturing considering corrosion and rust factors involved in salt and clear water, 300 series stainless steel will be used.

From the foregoing it can be seen that an improved pontoon boat guidance system has been described. The pontoon boat guidance system enhances the maneuverability of the pontoon boat which the inventor was told by the manufacturer of pontoon boats was impossible to achieve, thereby increasing its commercial value. The pontoon boat guidance system enables the pontoon boat to turn sharply about its center axis.

It should be noted the the schematics of the improved pontoon boat guidance system are not drawn to scale and that distances of and between the figures are not to be considered significant.

Accordingly, it is intended that the foregoing disclosure and showings made in the drawing shall be considered only as illustrations of the principles of the invention.

What is claimed is:

1. An improvement to a guidance system used in a pontoon boat which is powered by an outboard motor wherein the guidance system includes:

a. a steering wheel mechanically coupled and mounted to the pontoon boat;

b. a push-pull cable mechanically coupled to the steering wheel and operated in response to movement thereof;

c. a push-pull cable mounting mechanically coupled to the push-pull cable and rigidly mounted to the pontoon boat;

d. an outboard motor having a lever arm disposed a particular distance from its vertical axis; and e. a base rigidly mounted to the pontoon boat and mechanically coupled to the outboard motor, said base adapted to allow the outboard motor to pivot about its vertical axis, said improvement comprising:

a. a first member having a first U-shaped end mechanically coupled to the push-pull cable mounting and a second U-shaped end;

b. a second member having a first end mechanically coupled to said second U-shaped end and a second end, said second member also having a slot disposed between said first and second end;

c. coupling means for connecting the push-pull cable to said slot and thereby mechanically coupling said second member to the push-pull cable; and d. connecting means for connecting said second end of said second member to the lever arm of the outboard motor.

* * * * *